US011280078B2

(12) United States Patent
Lee et al.

(10) Patent No.: US 11,280,078 B2
(45) Date of Patent: Mar. 22, 2022

(54) HOT WATER SYSTEM FOR BIDET COMPRISING FLOW PATH GUIDE TANK AND HOT WATER MODE METHOD USING THE SAME

(71) Applicant: COWAY CO., LTD., Gongju-si (KR)

(72) Inventors: Sung Hee Lee, Seoul (KR); Hee Joo Kang, Seoul (KR); Dong Ik Nam, Seoul (KR); Hyun Min Shin, Seoul (KR); Man Uk Park, Seoul (KR)

(73) Assignee: COWAY CO., LTD., Gongju-si (KR)

( * ) Notice: Subject to any disclaimer, the term of this patent is extended or adjusted under 35 U.S.C. 154(b) by 0 days.

(21) Appl. No.: 16/979,032

(22) PCT Filed: Mar. 6, 2019

(86) PCT No.: PCT/KR2019/002594

§ 371 (c)(1),
(2) Date: Sep. 8, 2020

(87) PCT Pub. No.: WO2019/172644

PCT Pub. Date: Sep. 12, 2019

(65) Prior Publication Data

US 2021/0071402 A1 Mar. 11, 2021

(30) Foreign Application Priority Data

Mar. 9, 2018 (KR) ..... 10-2018-0027998

(51) Int. Cl.

| | |
|---|---|
| ***E03D 9/08*** | (2006.01) |
| ***F24H 1/00*** | (2006.01) |
| ***F24H 1/10*** | (2006.01) |

(52) U.S. Cl.
CPC ..... *E03D 9/08* (2013.01); *F24H 1/0072* (2013.01); *F24H 1/101* (2013.01)

(58) Field of Classification Search
CPC ..... E03D 9/08
(Continued)

(56) References Cited

U.S. PATENT DOCUMENTS

2017/0350108 A1* 12/2017 Harashima ..... E03D 5/01
2018/0338667 A1* 11/2018 Hahm ..... A47L 15/0013

FOREIGN PATENT DOCUMENTS

KR 20-0357726 Y1 7/2004
KR 20-0358234 Y1 8/2004
(Continued)

OTHER PUBLICATIONS

International Search Report dated Jul. 9, 2019 in PCT/KR2019/002594 filed on Mar. 6, 2019, 2 pages.

*Primary Examiner* — Lori L Baker
(74) *Attorney, Agent, or Firm* — Oblon, McClelland, Maier & Neustadt, L.L.P.

(57) ABSTRACT

A hot water system for a bidet having a housing is provided. The hot water system includes: a water inlet pipe connected to a faucet; a flow path guide tank located at a lower portion in the housing so that water introduced into the water inlet pipe flows; a sheath heater provided in the housing and configured to heat water discharged from the flow path guide tank; and a water outlet pipe configured to supply water heated by the sheath heater to the outside. The flow path guide tank has a flow path guide hole formed through in an upward direction so that water introduced into the water inlet pipe flows into an upper portion inside the housing and exchanges heat with the sheath heater.

7 Claims, 9 Drawing Sheets

(58) Field of Classification Search
USPC ..... 4/420, 300, 256.1, 901, 905
See application file for complete search history.

(56) References Cited

FOREIGN PATENT DOCUMENTS

| | | | |
|---|---|---|---|
| KR | 10-0786217 | B1 | 12/2007 |
| KR | 10-2009-0029003 | A | 3/2009 |
| KR | 10-2011-0001737 | A | 1/2011 |
| KR | 10-1670014 | B1 | 10/2016 |
| KR | 10-1826786 | B1 | 2/2018 |

* cited by examiner

HOT WATER SYSTEM FOR BIDET COMPRISING FLOW PATH GUIDE TANK AND HOT WATER MODE METHOD USING THE SAME

BACKGROUND OF THE INVENTION

1. Field of the Invention

The present disclosure relates to a hot water system for a bidet comprising a flow path guide tank having a specific structure, and to a hot water mode method using the same. More particularly, the present disclosure relates to a hot water system for a bidet, in which a slope portion and a flow path guide hole are formed in the flow path guide tank, and to a hot water mode method using the same.

2. Description of the Related Art

A bidet is a device that is installed in a toilet seat and sprays washing water through a nozzle provided in a main body of the bidet to automatically perform anal cleaning and female local cleaning.

Since water is used in a washing process, the bidet device needs to supply washing water from a water supply device to a water tank, and the washing water supplied to the water tank is sprayed to the outside through the nozzle.

On the other hand, when it is desired to supply hot water to a user, it is more efficient to provide a miniaturized self-heating device in an environment where a separate heating facility is not provided.

For example, in the process of installing a device such as the bidet in a bathroom, rather than connecting both cold water and hot water lines of a faucet, connecting the cold water line and supplying hot water using the self-heating device greatly saves installation and maintenance costs.

In the case of a conventional heating device, a method of heating and supplying water by itself inside a tank which temporarily stores water is widely used.

However, this method has a problem in that water is heated only around a heater provided inside the tank, so that the water inside the tank is not heated evenly. In the process of passing through the inside of the tank, water flowing inside the heating device for a hot water tank is directly discharged without passing through the heater, and thus water is supplied in an unheated state.

Meanwhile, Korean Application Publication 10-2009-0029003 by the present applicant, which is a prior art, discloses a method of heating an electrode and heating water stored in a washing water tank by directly contacting the electrode with water.

However, this method has a problem that various defects such as cracking of a plate-shaped electrode occur, and in addition, the contact area between the water and the plate-shaped electrode is significantly low, so that only part of the water stored in the washing water tank is heated. Therefore, this method has a problem that there is remarkably lowered heating efficiency.

(Patent Document 1 Korean Application Publication 10-2009-0029003

SUMMARY OF THE INVENTION

The present disclosure is devised to solve the above problems.

Specifically, the present disclosure provides a structure in which a flow path of water introduced from a faucet is specifically formed so that a contact area and a contact time between water flowing inside a housing and a heating member may increase and heating efficiency may be increased.

The present disclosure also provides a method of reducing a hot water waiting time when a user uses a hot water mode of a bidet.

According to an aspect of the present disclosure, there is provided a hot water system (100) for a bidet, comprising a housing (110), the hot water system including a water inlet pipe (112) connected to a faucet (120), a flow path guide tank (130) located at a lower portion in the housing (110) so that water introduced into the water inlet pipe (122) flows, a sheath heater (140) provided in the housing (110) and configured to heat water discharged from the flow path guide tank (130), and a water outlet pipe (114) configured to supply water heated by the sheath heater (140) to the outside, wherein the flow path guide tank (130) may have a flow path guide hole (135) formed through in an upward direction so that water introduced into the water inlet pipe (112) flows into an upper portion inside the housing (110) and exchanges heat with the sheath heater (140).

The flow path guide tank (130) may separate an inside of the housing (110) into a water inlet space (110*a*) and a heating space (110*b*), wherein the water inlet space (110*a*) and the heating space (110*b*) may communicate with each other through the flow path guide hole (135).

The flow path guide tank (130) may include a water inlet portion (132) connected to the water inlet pipe (112) on one side of the water inlet portion (132), a slope portion (134) located on the other side of the water inlet portion (132) and being inclined downward so that water introduced through the water inlet portion (132) flows downward, and a plate portion (136) connected to a lower portion of the slope portion (134) and having the flow path guide hole (135), wherein the plate portion (136) may be formed in such a way that water introduced through the slope portion (134) flows through the water inlet portion (110*a*) and is discharged into the heating space (110*b*) through the flow path guide hole (135).

The sheath heater (140) may be located at an upper side of the plate portion (136) and may include a ring portion (142) repeated in a spiral shape, and the flow path guide hole (135) may be formed along an outer circumferential surface of a top surface of the plate portion (136) and may be formed at a position where the flow path guide hole (135) corresponds to the ring portion (142) of the sheath heater (140) in a vertical direction.

The plate portion (136) may include a pair of coupling portions (138) through which the flow path guide tank (130) is fixed to a bottom surface inside the housing (110).

The hot water system may further include a first sensor (150) located at the water inlet pipe (112) and configured to measure a temperature of water introduced, a second sensor (152) located at the water outlet pipe (114) and configured to measure a temperature of water discharged, and a control unit (160) configured to control an operation of the sheath heater (140) through the temperatures measured by the first and second sensors (150, 152) and a temperature difference thereof.

The water inlet pipe (112) may be located at a lower portion of the housing (110), and the water outlet pipe (114) may be located on a top end of the housing (110) so that water introduced from the water inlet pipe (112) rises in the housing (110) and heat-exchanges with the sheath heater (140).

The hot water system may further include a safety device (170), wherein the safety device (170) may include a bimetal (172) configured to operate when a temperature of water flowing through the housing (110) is higher than or equal to a first temperature, and a thermal fuse (174) configured to operate when a temperature of water flowing through the housing (110) is higher than or equal to a second temperature that is higher than the first temperature.

The hot water system may further include a pressure reducing valve (122) provided between the faucet (120) and the water inlet pipe (112), wherein the pressure reducing valve (122) may maintain a pressure of water supplied to the water inlet pipe (112) at a preset value or less.

According to another aspect of the present disclosure, there is provided a hot water mode method for a bidet, comprising the hot water system for a bidet described above, wherein the bidet includes a seating sensor, and the hot water mode method including (a) detecting a user's seating on a seating portion of the bidet by using a seating sensor (S100), and (b) if the user's seating is detected by the seating sensor, operating the sheath heater (140) to heat water in the housing (110) and to preheat to a preset waiting temperature (S110).

The user may be capable of setting a water outlet temperature of the bidet, and after the (b)(S110) is performed, the hot water mode method further including (c) comparing a water outlet temperature of the bidet set by the user with a current temperature (S120), and (d) if it is determined in the (c)(S120) that the current temperature is lower than the water outlet temperature, operating the sheath heater (140) so that water in the housing (110) rises to the water outlet temperature (S140).

BRIEF DESCRIPTION OF THE DRAWINGS

The above and other features and advantages of the present disclosure will become more apparent by describing in detail exemplary embodiments thereof with reference to the attached drawings in which.

DETAILED DESCRIPTION OF THE INVENTION

Figure 1:
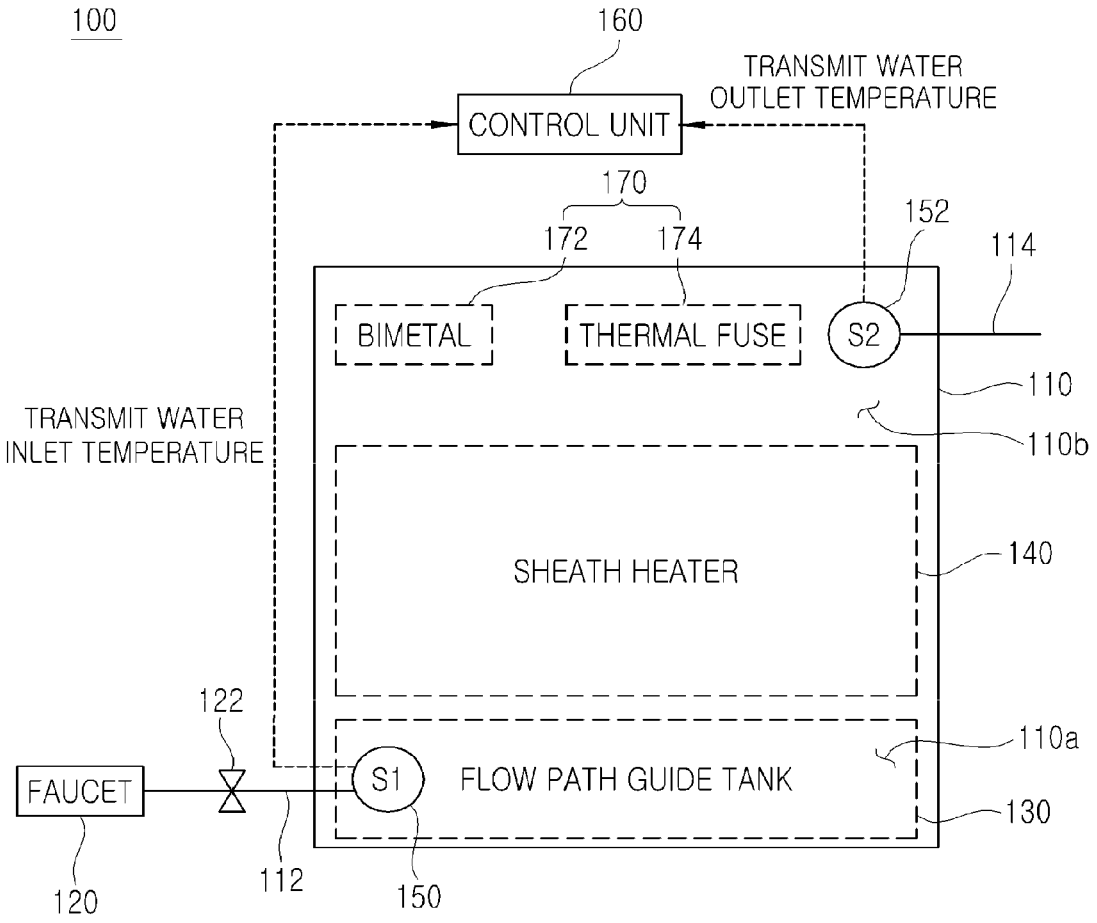
FIG. 1 is a block diagram of a hot water system for a bidet according to an embodiment of the present disclosure.
Figure 2:
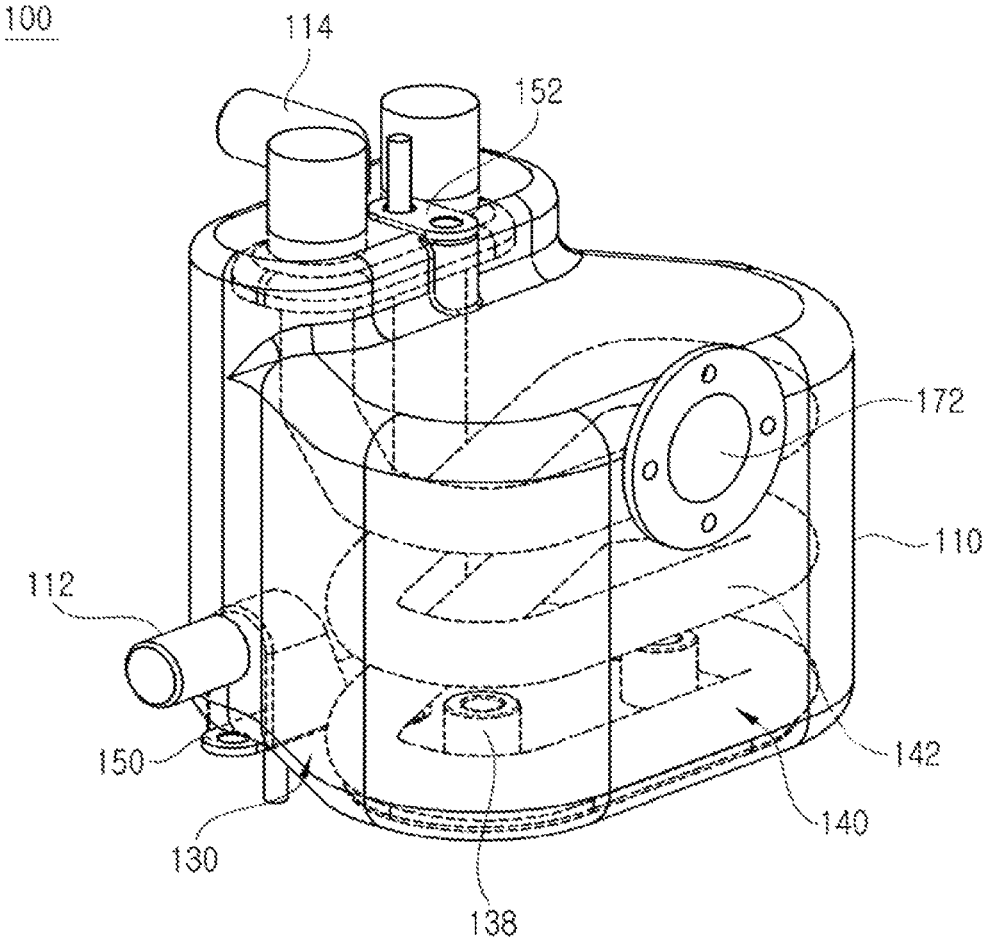
FIG. 2 is a perspective view illustrating the hot water system for a bidet according to an embodiment of the present disclosure.
Figure 3:
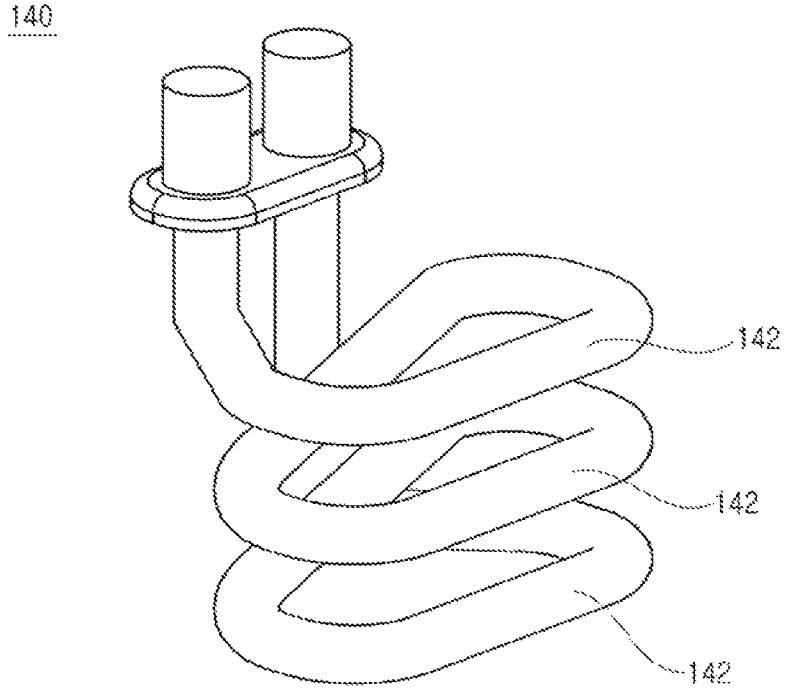
FIG. 3 is a perspective view of a sheath heater used in the hot water system for a bidet according to an embodiment of the present disclosure.
Figure 4:
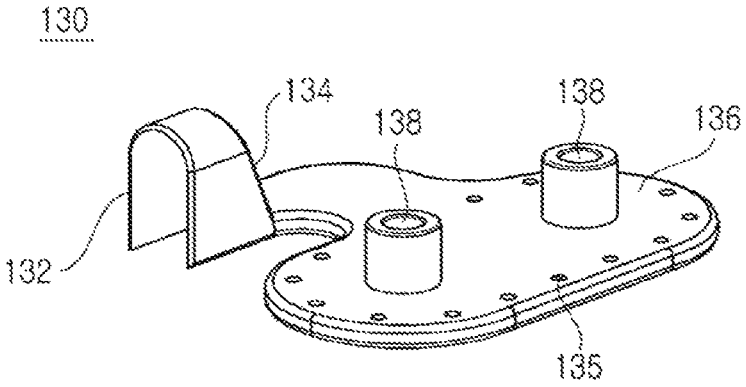
FIG. 4 is a perspective view of a flow path guide tank used in the hot water system for a bidet according to an embodiment of the present disclosure.
Figure 5:
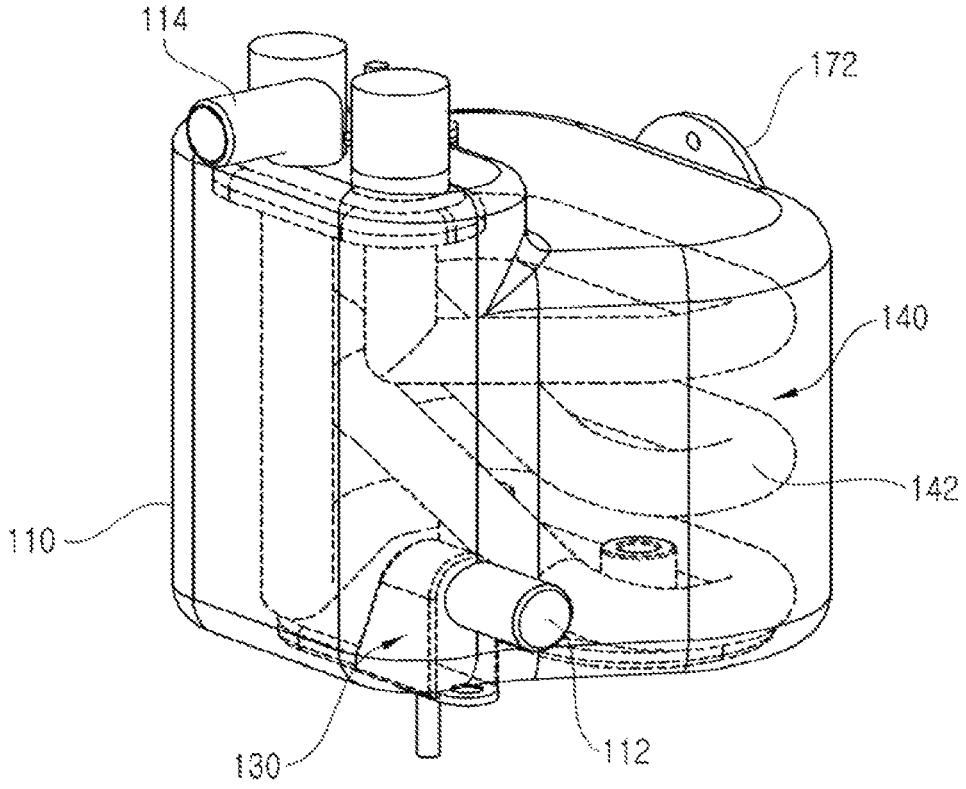
FIG. 5 is a perspective view of the hot water system for a bidet according to an embodiment of the present disclosure as viewed from a different direction from FIG. 2.
Figure 6:
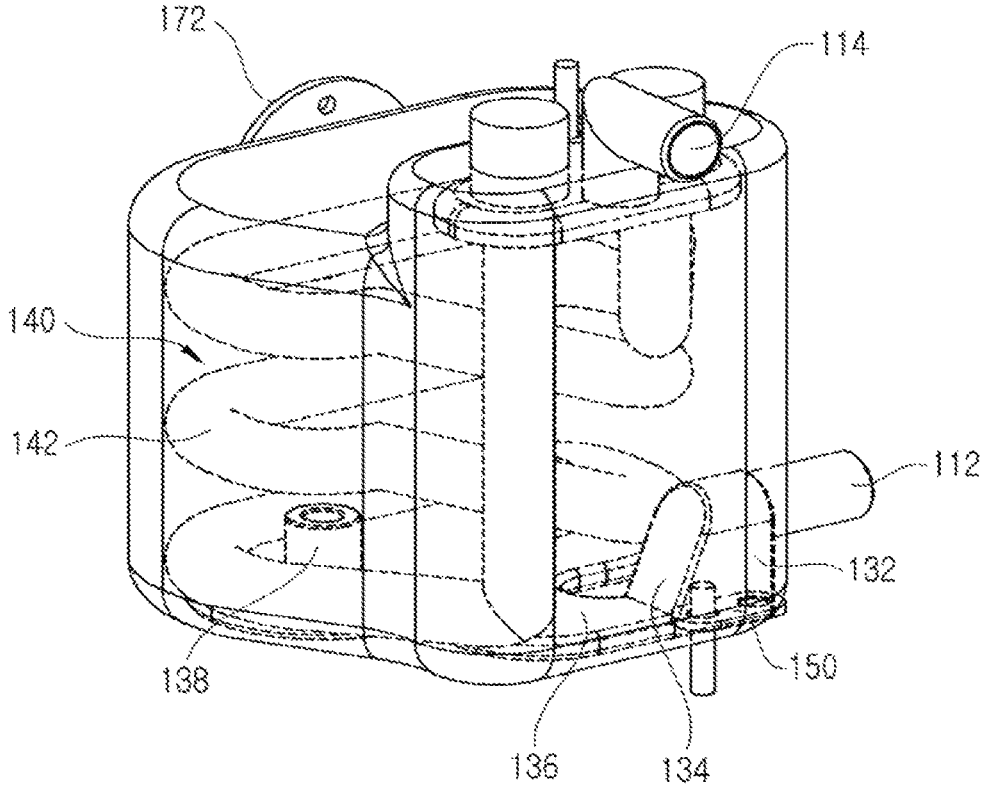
FIG. 6 is a perspective view of the hot water system for a bidet according to an embodiment of the present disclosure as viewed from a different direction from FIGS. 2 and 5.
Figure 7:
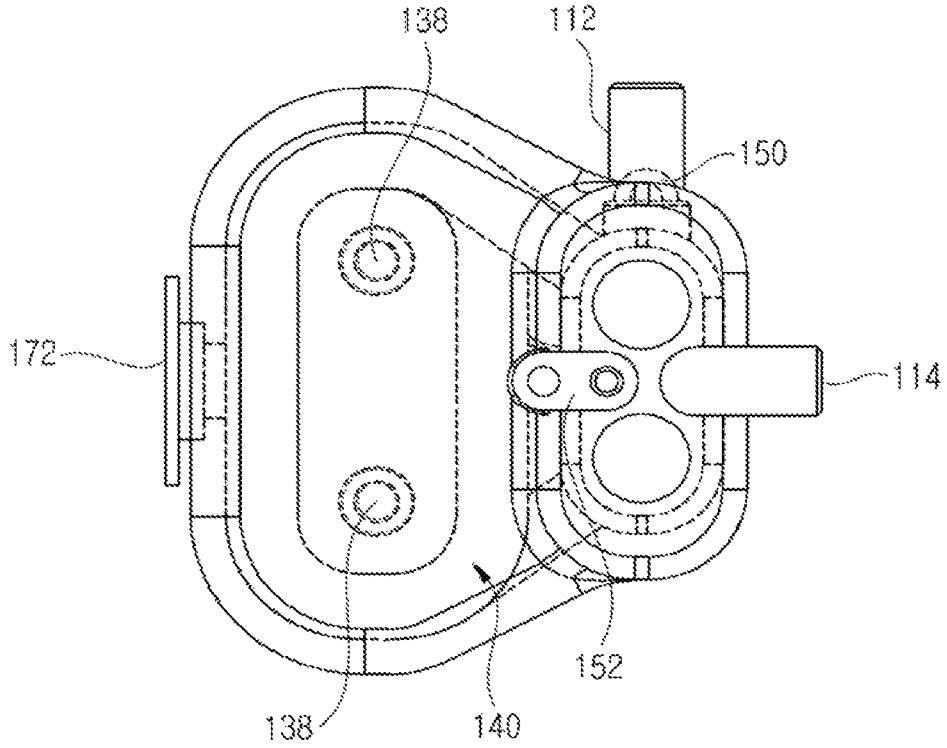
FIG. 7 is a bottom view of the hot water system for a bidet according to an embodiment of the present disclosure from a downward direction.
Figure 8:
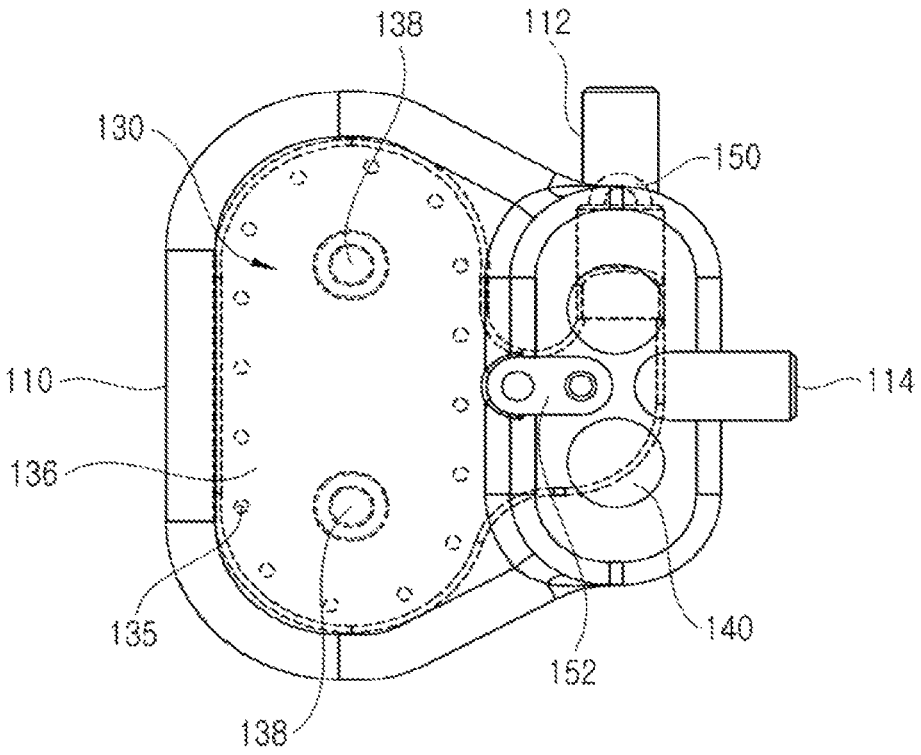
FIG. 8 is a plan view of the hot water system for a bidet according to an embodiment of the present disclosure from an upward direction.

Hereinafter, the term "housing" refers to a storage tank that can temporarily store water supplied from a faucet, and in the drawings, the housing is transparently illustrated for explanation of the inside of the housing.

In addition, the term "sheath heater" refers to an electric heater that can instantaneously heat water stored in the housing, and thus refers to a heater in which an electric heating wire is embedded in a coil form in a metal protection tube.

1. Description of Configuration of Hot Water System for Bidet

FIG. 1 is a block diagram of a hot water system for a bidet according to an embodiment of the present disclosure.

Referring to FIG. 1, the hot water system 100 for a bidet according to an embodiment of the present disclosure comprises a housing 110, and a water inlet pipe 112, a flow path guide tank 130, a sheath heater 140, a water outlet pipe 114, and a control unit 160.

In this case, the water inlet pipe 112 formed on one side of the housing 110 is connected to a faucet 120 for supplying water at a certain pressure, and water heated by the sheath heater 140 in the housing 110 is supplied to a user through the water outlet pipe 114 formed on the other side of the housing 110.

In addition, a pressure reducing valve 122 is provided between the faucet 120 and the water inlet pipe 112, and the pressure of water supplied from the faucet 120 is 0.7 $kgf/cm^2$ to 7 $kgf/cm^2$. Thus, the pressure of water supplied from the faucet 120 by the pressure reducing valve 122 is reduced to 1.2 $kgf/cm^2$ or less, and the water is supplied to the water inlet pipe 112 so that components embedded in the housing 110 may be protected.

Inside of the housing 110 comprises the flow path guide tank 130, the sheath heater 140, and a bimetal 172 and a thermal fuse 174, which are a safety device 170.

At this time, the flow path guide tank 130 is located at a lower portion of the housing 110 and spatially separates the inside of the housing 110. Thus, water introduced through the water inlet pipe 112 first passes through the flow path guide tank 130.

The sheath heater 140 is located at an upper side of the flow path guide tank 130 and is preferably formed in a spiral shape, i.e., in the form of a spiral rising in an upward direction, and may be formed to have a power amount of 1,400 W.

Meanwhile, the bimetal 172 and the thermal fuse 174 are the safety device 170 that protects the hot water system 100 for a bidet, and the bimetal 172 may operate when the temperature of water is higher than or equal to a first temperature, and the thermal fuse 174 may operate when the temperature of water is higher than or equal to a second temperature, so that the operation of the hot water system 100 for a bidet may be forcibly stopped.

Specifically, the first temperature of the bimetal 172 is set to 55° C. so that the user may be prevented from getting burned due to overheating of water according to a malfunction of the sheath heater 140, and the thermal fuse 174 is set to 70° C. so that, when an internal fire of the housing 110 occurs, the operation of the hot water system 100 for a bidet may be forcibly stopped to protect internal parts.

On the other hand, the hot water system 100 for a bidet according to the present disclosure comprises a first sensor 150 for measuring the temperature of water received into the housing 110 and a second sensor 152 for measuring the temperature of water supplied to the user, and further comprises the control unit 160 for receiving temperature information from the first and second sensors 150 and 152.

To this end, the first sensor 150 may be located adjacent to the water inlet pipe 112, and preferably, may be located at an entrance of the flow path guide tank 130, and the second sensor 152 may be located adjacent to the water outlet pipe 114.

In this case, the control unit 160 is formed to calculate a difference in a water inlet temperature transmitted from the first sensor 150 and a water outlet water temperature transmitted from the second sensor 152 in real time, and is formed to control the water outlet temperature.

Specifically, the hot water system 100 for a bidet according to the present disclosure is formed so that the user can select the water outlet temperature in three stages, and it is preferable to allow the user to select any one of 33° C., 35° C., and 38° C.

The control unit 160 receives information about the water outlet temperature from the second sensor 152 for measuring the water outlet temperature in real time, and if the temperature selected by the user is different from the water outlet temperature transmitted from the second sensor 152, the sheath heater 140 operates so that the temperature of water supplied to the water outlet pipe 114 may reach the temperature selected by the user.

2. Description of Internal Structure of Housing of Hot Water System for Bidet

Hereinafter, a detailed internal structure of the hot water system for a bidet according to an embodiment of the present disclosure will be described with reference to FIGS. 2 to 8.

The inside of the housing 110 of the hot water system 100 for a bidet according to an embodiment of the present disclosure comprises the flow path guide tank 130 and the sheath heater 140.

As the flow path guide tank 130 is provided inside the housing 110, the flow path guide tank 130 may separate the inside of the housing 110 into a water inlet space 110*a* and a heating space 110*b*.

The flow path guide tank 130 includes a water inlet portion 132, a slope portion 134, and a plate portion 136.

The water inlet portion 132 is connected to the water inlet pipe 112 described above, and includes a pair of plates and a bent portion, and the bent portion connects top ends of the pair of facing plates and thus the vertical cross-section of the water inlet portion 132 has a "∩" shape.

At this time, the housing 110 may have a through hole through which the water inlet pipe 112 can be closely inserted, because the upper portion of the vertical cross-section of the water inlet portion 132 is inserted in the horizontal direction of the water inlet pipe 112.

The slope portion 134 is formed on the other side of the water inlet portion 132 to be inclined downward so that water introduced through the water inlet portion 132 may forcibly flow downward. Thus, the pressure of the water introduced through the water inlet portion 132 is structurally reduced so that internal components of the housing 110 may be protected.

In addition, a lower portion of the slope portion 134 communicates with the plate portion 136 so that water introduced into the slope portion 134 may flow into the plate portion 136.

The plate portion 136 is formed in such a way that water introduced through the slope portion 134 flows into the water inlet space 110*a* and is discharged into the heating space 110*b* through the flow path guide hole 135.

In detail, the plate portion 136 has a sealed structure in which an upper plate and a lower plate of the plate portion 136 are connected to each other, and the lower plate is located to face a bottom surface of the housing 110, so that water may flow into a space between the upper plate and the lower plate.

At this time, the upper plate has a flow path guide hole 135, and water flowing in the plate portion 136 through the flow path guide hole 135 is discharged into the heating space 110*b*. Thus, the flow path guide hole 135 serves to communicate the water inlet space 110*a* and the heating space 110*b*.

In addition, as the flow path guide hole 135 has a certain diameter and is formed through in the upward direction, water flowing through the plate portion 136 is discharged at a constant pressure upward and contacts the sheath heater 140.

In this regard, as described above, the sheath heater 140 is located on an upper side of the plate portion 136, and comprises a ring portion 142 repeated in a spiral shape. In addition, the number of ring portions 142 may be properly changed according to a designer's selection considering the size of the housing 110, the capacity of the sheath heater 140, etc.

At this time, the flow path guide hole 135 is formed along an outer circumferential surface of a top surface of the plate portion 136 and is formed at a position where the flow path guide hole 135 corresponds to the ring portion 142 of the sheath heater 140 in a vertical direction.

Thus, water discharged through the flow path guide hole 135 flows in the upward direction and continuously exchanges heat directly with the ring portion 142 so that heat-exchanging efficiency may be maximized.

Meanwhile, the water inlet pipe 112 is located at a lower portion of the housing 110, and the water outlet pipe 114 is located at a top end of the housing 110, so that water introduced from the water inlet pipe 112 may rise in the housing 110 and may be formed to exchange heat with the sheath heater 140.

In addition, since the direction of the water inlet pipe 112 and the direction of the water outlet pipe 114 are perpendicular to each other based on the horizontal direction, time when water remains in the heating space 110*b* is maximized so that a contact time between water flowing through the heating space 110*b* and the sheath heater 140 may be maximized.

Meanwhile, the plate portion 136 has a pair of coupling portions 138 through which the flow path guide tank 130 is fixed to the bottom surface inside the housing 110, and the pair of coupling portions 138 may be fastened using a bolt-nut fastening method.

3. Hot Water Mode Method for Bidet

Hereinafter, a hot water mode method for a bidet according to an embodiment of the present disclosure will be described, and the bidet comprises a seating sensor that detects the user's seating when the user sits on a seating portion of the bidet.

Figure 9:
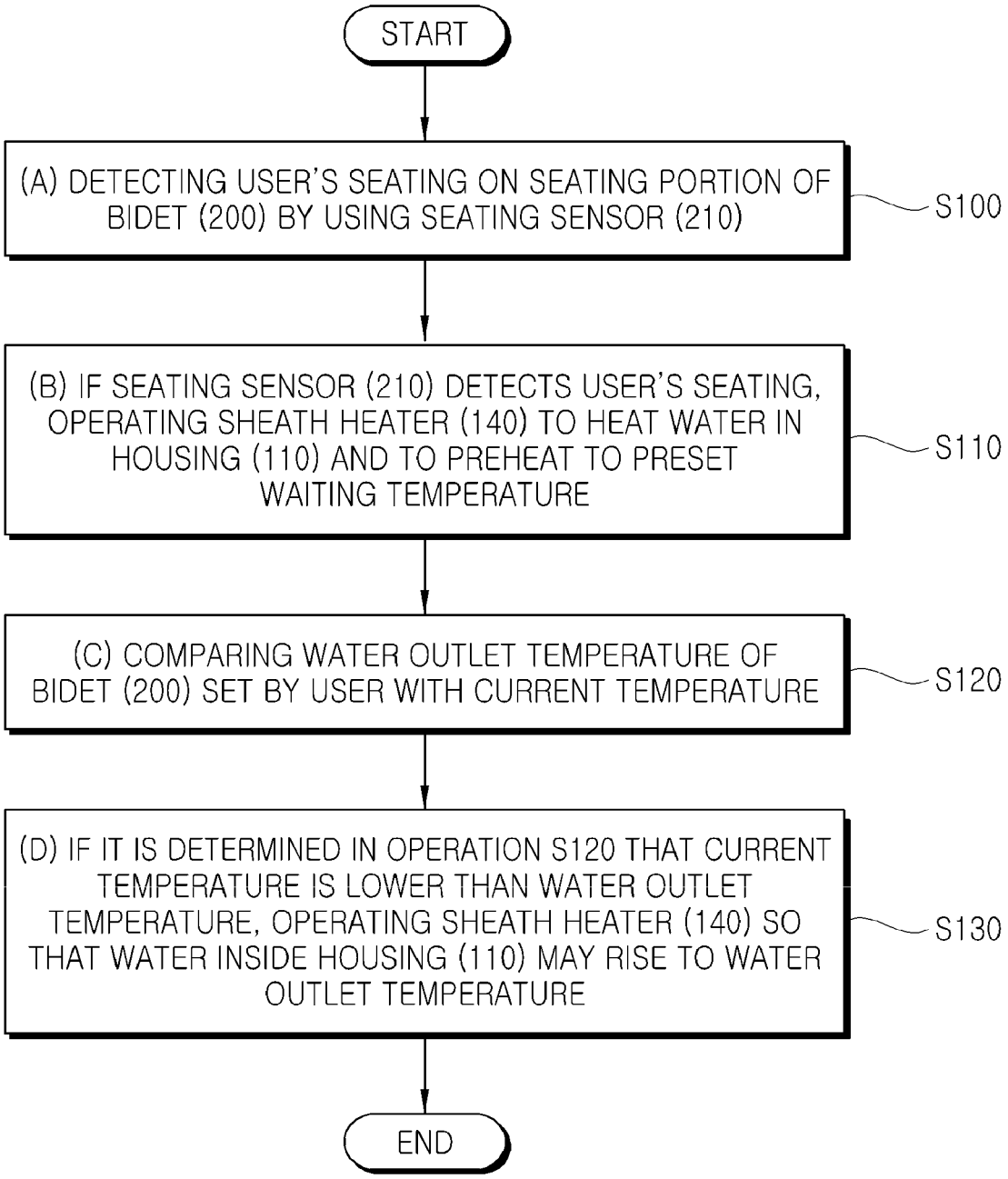
FIG. 9 is a flowchart illustrating a hot water mode method for a bidet according to an embodiment of the present disclosure.

Referring to FIG. 9, the hot water mode method for the bidet according to an embodiment of the present disclosure comprises detecting the user's seating on the seating portion of the bidet by using the seating sensor (Operation S100), and if the seating sensor detects the user's seating, operating the sheath heater 140 to heat water in the housing 110 and to preheat to a preset waiting temperature (Operation S110).

In this way, as the hot water mode method for the bidet according to an embodiment of the present disclosure includes Operation S110, unlike in an existing storage type structure, the effect of significantly reducing the waiting time for hot water is shown, and it is preferable that the preset waiting temperature is 30° C.

In addition, the user is capable of setting the water outlet temperature of the bidet according to his/her own taste, and after Operation S110 is performed, the hot water mode method for the bidet according to an embodiment of the present disclosure further comprises comparing the water outlet temperature of the bidet set by the user with a current temperature (Operation S120), and if it is determined in Operation S120 that the current temperature is lower than the water outlet temperature, operating the sheath heater 140 so that water inside the housing 110 may rise to the water outlet temperature (Operation S130).

As described above, the water outlet temperature is formed to allow the user to select in three stages, and the user may select one of 33° C., 35° C., and 38° C., preferably.

In this way, the hot water mode method for the bidet according to an embodiment of the present disclosure provides the user's desired water outlet temperature and simultaneously re-heats water that has already been preheated to a certain extent by performing the additional heating process of Operation S130, so that the user's desired water outlet temperature may be reached within a short time.

While the present disclosure has been particularly shown and described with reference to exemplary embodiments thereof, it will be understood by those of ordinary skill in the art that various changes in form and details may be made therein without departing from the spirit and scope of the present disclosure as defined by the following claims.

What is claimed is:

1. A hot water system for a bidet, comprising a housing and a sheath heater installed in the housing, wherein water introduced through a water inlet pipe is heated by the sheath heater and is discharged through a water outlet pipe, the hot water system comprising:

the water inlet pipe formed on one side of a lower portion of the housing and connected to a faucet;

a flow path guide tank located at a lower portion in the housing so that water introduced into the water inlet pipe flows;

the sheath heater provided in the housing and configured to heat water discharged from the flow path guide tank; and the water outlet pipe formed on an upper surface of the housing and configured to supply water heated by the sheath heater to the outside, wherein the flow path guide tank has the flow path guide hole formed through in an upward direction so that water introduced into the water inlet pipe flows into an upper portion inside the housing and exchanges heat with the sheath heater, wherein a water inlet space communicating with the water inlet pipe is formed in the flow path guide tank, wherein the flow path guide tank comprises:

a water inlet portion connected to the water inlet pipe, a slope portion located on the other side of the water inlet portion and being inclined downwardly so that water introduced through the water inlet portion flows downwardly into the water inlet space, and a plate portion connected to a lower portion of the slope portion and having the flow path guide hole communicating the water inlet space and a heating space where water discharged from the water inlet space is heated each other through the flow path guide hole, wherein the sheath heater is located on an upper side of the plate portion and comprises a ring portion repeated in a spiral shape, wherein the flow path guide hole is formed along an outer circumferential surface of a top surface of the plate portion and is formed at a position where the flow path guide hole corresponds to the ring portion of the sheath heater in a vertical direction, wherein a distance from a bottom surface of the housing to a top surface on which the water outlet pipe is formed is longer than a distance from a bottom surface of the housing to a top surface on which the water outlet pipe is not formed, and wherein one side of the sheath heater and the other side of sheath heater extend downward from the top surface on which the water outlet pipe is formed, and then bend forming a loop portion.

2. The hot water system of claim 1, wherein the plate portion comprises a pair of coupling portions through which the flow path guide tank is fixed to a bottom surface inside the housing.

3. The hot water system of claim 1, further comprising:

a first sensor located at the water inlet pipe and configured to measure a temperature of water introduced;

a second sensor located at the water outlet pipe and configured to measure a temperature of water discharged; and a control unit configured to control an operation of the sheath heater through the temperatures measured by the first and second sensors and a temperature difference thereof.

4. The hot water system of claim 1, further comprising a safety device, wherein the safety device comprises:

a bimetal configured to operate when a temperature of water flowing through the housing is higher than or equal to a first temperature; and a thermal fuse configured to operate when a temperature of water flowing through the housing is higher than or equal to a second temperature that is higher than the first temperature.

5. The hot water system of claim 1, further comprising a pressure reducing valve provided between the faucet and the water inlet pipe, wherein the pressure reducing valve maintains a pressure of water supplied to the water inlet pipe at a preset value or less.

6. A hot water mode method for a bidet, comprising the hot water system for a bidet of claim 1, wherein the bidet comprises a seating sensor, and the hot water mode method comprising:

detecting a user's seating on a seating portion of the bidet by using the seating sensor; and if the user's seating is detected by the seating sensor, operating the sheath heater to heat water in the housing and to preheat to a preset waiting temperature.

7. The hot water mode method of claim 6, wherein a water outlet temperature of the bidet is capable of being set by the user, and after the operating the sheath heater to heat water in the housing and to preheat waiting temperature is performed, the hot water mode method further comprising:

comparing a water outlet temperature of the bidet set by the user with a current temperature; and if it is determined in the comparing that the current temperature is lower than the water outlet temperature, operating the sheath heater so that water in the housing rises to the water outlet temperature.

* * * * *